US009879562B2

(12) United States Patent
Vatin

(10) Patent No.: US 9,879,562 B2
(45) Date of Patent: Jan. 30, 2018

(54) COMPRESSOR GUIDE-VANE STAGE FOR A TURBINE ENGINE INCLUDING A GASKET BETWEEN A VANE AND A SHROUD OF THE GUIDE-VANE STAGE

(71) Applicant: SNECMA, Paris (FR)

(72) Inventor: Eric Raymond Jean Vatin, Paris (FR)

(73) Assignee: SNECMA, Paris (FR)

( * ) Notice: Subject to any disclaimer, the term of this patent is extended or adjusted under 35 U.S.C. 154(b) by 1064 days.

(21) Appl. No.: 13/856,655

(22) Filed: Apr. 4, 2013

(65) Prior Publication Data

US 2013/0266437 A1 Oct. 10, 2013

(30) Foreign Application Priority Data

Apr. 5, 2012 (FR) ..... 12 53174

(51) Int. Cl.
*F01D 25/00* (2006.01)
*F04D 19/02* (2006.01)
(Continued)

(52) U.S. Cl.
CPC ..... *F01D 25/00* (2013.01); *F04D 19/022* (2013.01); *F04D 29/083* (2013.01); *F04D 29/542* (2013.01); *Y10T 29/49238* (2015.01)

(58) Field of Classification Search
CPC ..... F01D 25/00; F01D 9/044; F04D 19/022; F04D 29/083; F04D 29/542;
(Continued)

(56) References Cited

U.S. PATENT DOCUMENTS 4,690,413 A * 9/1987 Adkins ..... B26F 3/002 206/223
7,311,495 B2 * 12/2007 Ashley ..... F01D 5/26 415/209.4
(Continued)

FOREIGN PATENT DOCUMENTS

EP 1 741 878 A2 1/2007
EP 2 075 415 A1 7/2009
(Continued)

OTHER PUBLICATIONS

English Machine Translation of EP 2075415 A1 (Translated on Oct. 25, 2016).*
(Continued)

*Primary Examiner* — Mark Laurenzi
*Assistant Examiner* — Paul Thiede
(74) *Attorney, Agent, or Firm* — Oblon, McClelland, Maier & Neustadt, L.L.P.

(57) ABSTRACT

A compressor guide-vane stage for a turbine engine, the stage comprising two coaxial shrouds, respectively an inner shroud (120) and an outer shroud, with vanes (124) extending between them, the radially inner ends of the vanes being engaged with clearance (125) in orifices in the inner shroud and being secured to the inner shroud by means of a polymerizable sealing resin (126), the guide-vane stage being characterized in that a gasket (140) is mounted on the radially inner end of each vane, the gasket including a slit through which the vane passes and bearing against the radially inside surface of the shroud or in the proximity of said surface, in order to limit the passage of resin through the above-mentioned clearance while the resin is being applied to the inside surface of the shroud.

9 Claims, 3 Drawing Sheets

(51) Int. Cl.
*F04D 29/54* (2006.01)
*F04D 29/08* (2006.01)

(58) Field of Classification Search
CPC ..... F04D 29/541; Y10T 29/49238; F05D 2230/23; F05D 2230/60
USPC ..... 415/209.4; 416/193 A; 701/100; 29/889.1
See application file for complete search history.

(56) References Cited

U.S. PATENT DOCUMENTS 7,503,113 B2 * 3/2009 Gosling ..... B23P 6/002 29/889
8,324,296 B2 * 12/2012 Kaneda ..... C08K 5/34928 524/100
2006/0228211 A1 * 10/2006 Vance ..... F01D 5/14 415/200
2007/0043497 A1 * 2/2007 Leogrande ..... F01D 11/24 701/100
2008/0217237 A1 * 9/2008 Deedrich ..... B01D 27/08 210/444
2010/0080692 A1 4/2010 Tudor et al.
2011/0243742 A1 * 10/2011 Dezouche ..... F01D 9/042 416/193 A

FOREIGN PATENT DOCUMENTS

EP 2 434 101 A2 3/2012
GB 2 418 709 A 4/2006

OTHER PUBLICATIONS

French Preliminary Search Report dated Dec. 3, 2012, in French 1253174, filed Apr. 5, 2012 (with English Translation of Categories of Cited Documents).

* cited by examiner

COMPRESSOR GUIDE-VANE STAGE FOR A TURBINE ENGINE INCLUDING A GASKET BETWEEN A VANE AND A SHROUD OF THE GUIDE-VANE STAGE

BACKGROUND OF THE INVENTION

Field of the Invention

The present invention relates to a compressor guide-vane stage for a turbine engine, in particular for a low-pressure compressor of a turbine engine.

Description of the Related Art

A turbine engine compressor includes at least one guide-vane stage comprising two coaxial shrouds extending one inside the other with substantially radial vanes extending between them, which vanes are connected at their radial ends to the shroud.

The outer shroud of a guide-vane stage has radial orifices in which the radially outer ends of the vanes are engaged and fastened, generally by welding. The inner shroud of the guide-vane stage has radial orifices in which the radially inner ends of the vanes are engaged with clearance, such clearance being of the order of 2 millimeters (mm) to 3 mm, approximately.

In the prior art, the inner ends of the vanes are secured to the inner shroud by means of a polymerizable sealing resin that is applied to the inside surface of the shroud and that, once hardened, serves to fasten the vanes to the shroud. The resin forms an annular block inside the inner shroud in which the radially inner ends of the vanes are embedded and presenting an inner periphery that defines an abradable track for co-operating with annular wipers of a rotor in order to form a labyrinth type seal.

Before the resin is applied to the inner shroud, it is known to inject the same resin into the above-mentioned clearance between each vane and the edges of the orifice in the inner shroud, around the entire periphery of each vane. This makes it possible to fill in the clearance beforehand and prevent a fraction of the resin subsequently passing through the clearance while the resin is being applied to the inner shroud (in order to avoid wasting resin and in order to limit the time taken for cleaning the guide-vane stage in order to eliminate any runs of resin therefrom). At present, resin is injected into the clearance by means of a syringe that is filled by an operator, with this injection step being lengthy and expensive (taking about 8 hours for one guide-vane stage), difficult, dirtying, and poorly reproducible. In order to limit the resin running when it is applied, it may be stored in a refrigerator prior to application in order to increase its viscosity. Nevertheless, although that makes it easier to work the resin, it involves complex management of batches of resin.

BRIEF SUMMARY OF THE INVENTION

The present invention applies a simple, effective, and inexpensive solution to that problem.

To this end, the invention provides a compressor guide-vane stage for a turbine engine, the stage comprising two coaxial shrouds, respectively an inner shroud and an outer shroud, with substantially radial vanes extending therebetween, the radially outer ends of the vanes being welded to the outer shroud and the radially inner ends being engaged with clearance in orifices in the inner shroud and being secured to the inner shroud by a polymerizable sealing resin applied to the inside surface of the shroud and defining an abradable track after hardening, the guide-vane stage being characterized in that a gasket is mounted on the radially inner end of each vane, the gasket having a slit through which the vane passes and being mounted to bear against or to be in contact with the radially inside surface of the shroud in order to limit the passage of resin through the above-mentioned clearance during its application.

The invention makes it possible to eliminate the prior art step that consists in injecting the resin by means of a syringe into the clearance between each vane and the edges of the corresponding orifice in the inner shroud, prior to applying the resin to the inside surface of the shroud. This injection step, which is awkward and difficult to perform, is replaced by a step that is simpler and much faster in which gaskets are mounted on the radially inner ends of the vanes (it takes 30 minutes to mount gaskets of the invention on all of the vanes of a guide-vane stage, in one particular embodiment of the invention). The gaskets serve to replace the above-described injection of resin in the clearance around each vane, and thus serve to prevent resin from passing through the clearance and running radially outwards into the guide-vane stage. The gasket thus guarantees sealing between the vanes and the edges of the orifices in the inner shroud, which sealing can be provided by pressing the gaskets radially against the inside surface of the inner shroud. The gaskets and the radially inner ends of the vanes are designed to be embedded in the resin that, once hardened, defines a radially inner abradable track.

The resin and the gaskets are preferably made of the same material based on silicone, for example of the room temperature vulcanization (RTV) type. The gaskets of the invention are thus made of the same material as the resin that is injected in the prior art, which means there is no need to alter the specification defining the engine and its certification.

Advantageously, in the mounted position, each gasket forms a continuous band extending all around the end of the corresponding vane, the outer periphery of the band bearing against the radially inside surface of the shroud or being in the proximity of said surface.

The thickness of the gasket may be determined firstly so that it has sufficient tearing strength and secondly so as to enable it to retain a certain amount of flexibility in order to fit as closely as possible to the shape of the inside surface of the shroud when in the mounted position. By way of example, each gasket has a thickness of the order of 2 mm to 3 mm.

The present invention also provides a gasket for a turbine engine guide-vane stage as described above, the gasket being characterized in that it includes a concave curved edge and a convex curved edge for extending respectively beside the pressure side and beside the suction side of a vane, and it includes a through line of cut that extends between and along the above-mentioned edges, and that, in the free state without stress, extends with an angle of curvature that is substantially identical to the angle of curvature of the suction side of the vane. The gasket may be made of silicone, e.g. of the RTV type.

The invention also provides a method of assembling a guide-vane stage of the above-specified type, the method being characterized in that it comprises the steps consisting in:

a) engaging the radially outer ends of the vanes in orifices in the outer shroud, and engaging the radially inner ends of the vanes in orifices in the inner shroud;
b) welding the outer ends of the vanes to the outer shroud;
c) engaging a gasket on the inner end of each vane until the gasket comes into contact with or into the vicinity of the inside surface of the inner shroud; and d) applying the sealing resin on the inside surface of the shroud and on the gaskets so as to embed them in the resin.

The method may include, prior to step c), a step consisting in coating the inside surface of the inner shroud with a substance that enhances the adhesion of the gaskets on said surface.

Step c) may be performed manually or by means of a tool of elongate shape and including a stepped longitudinal recess, said recess including a first portion or stage of shape substantially complementary to a gasket and situated at one end of the tool, and a second portion or stage of shape substantially complementary to the radially inner end of a vane and having a depth that is not less than the length of the end portion of the vane that extends beyond the gasket when the gasket is in the mounted position on the vane.

The method may include a preliminary step of fabricating gaskets, either by cutting slices from an extruded section member of elongate shape, or by molding in recesses in a surface of a plate that is scraped after the resin has been deposited and before it has hardened.

BRIEF DESCRIPTION OF THE SEVERAL VIEWS OF THE DRAWINGS

The present invention can be better understood, and other details, characteristics, and advantages of the present invention appear more clearly on reading the following description made by way of non-limiting example and with reference to the accompanying drawings, in which.

DETAILED DESCRIPTION OF THE INVENTION

Figure 1:
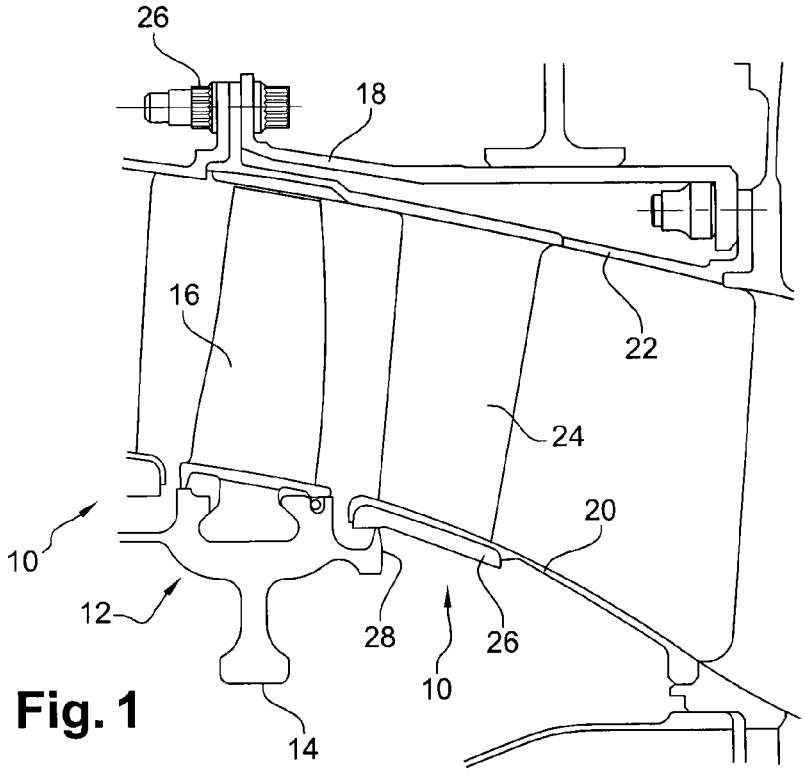
FIG. 1 is a fragmentary diagrammatic half-view in axial section of a turbine engine compressor, including a guide-vane stage.

Reference is made initially to FIG. 1, which shows a low-pressure compressor of a turbine engine such as an airplane turbojet or turboprop, the compressor having guide-vane stages 10 with moving-blade stages 12 located between them.

Each moving-blade stage 12 comprises a disk 14 carrying an angular row of substantially radial blades 16 at its periphery, the blades being surrounded by a casing 18 of the compressor.

Each guide-vane stage 10 comprises two shrouds, respectively an inner shroud 20 and an outer shroud 22, between which there extends an annular row of substantially radial vanes 24, the outer shroud 22 being fastened to the casing 18 by nut-and-bolt type means 26.

Figure 2:
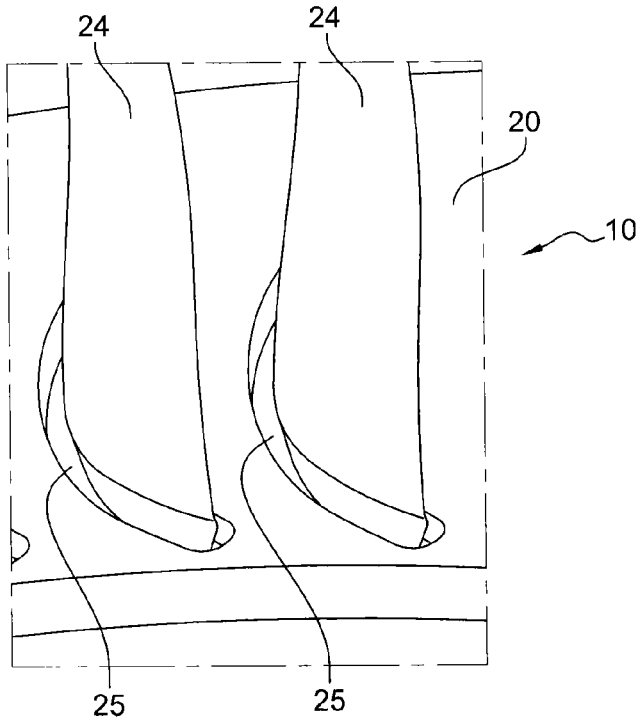
FIG. 2 is a fragmentary diagrammatic view in perspective of the inner shroud and of the vanes of the FIG. 1 stage.

The radially outer ends of the vanes 24 are welded to the outer shroud 22. The radially inner ends of the vanes 24 are engaged with clearance 25 in orifices of the inner shroud 20 (FIG. 2) and they are secured to the inner shroud 20 by applying a polymerizable sealing resin 26 on the radially inner surface of the shroud, with the radially inner ends of the vanes 24 being embedded in the resin. After the resin 26 has hardened, it forms an annular block on the inside of the inner shroud 20, the inner periphery of this block defining an abradable track for co-operating with an annular wiper 28 carried by the disk 14 of a moving blade stage 12 so as to form a labyrinth type seal.

Figure 3:
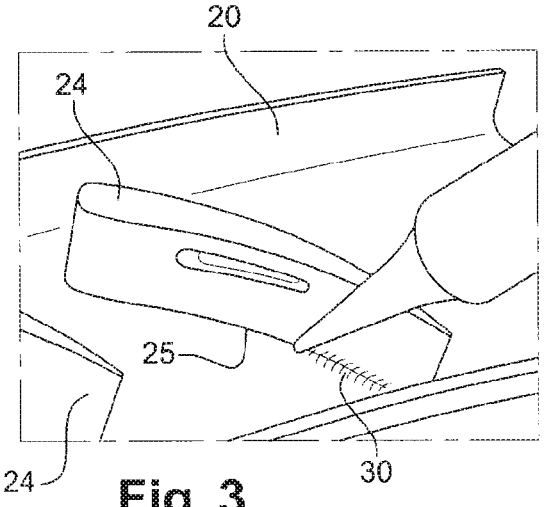
Fig. 3 Prior Art
FIG. 3 is a fragmentary diagrammatic view in perspective of the inner shroud and of vanes of the prior art guide-vane stage, and it shows a step in the fabrication of that stage.
Figure 4:
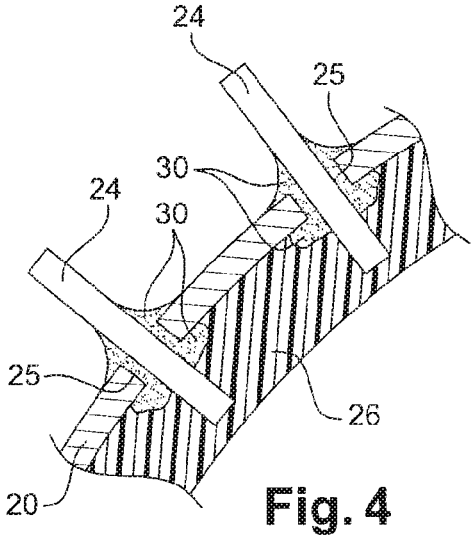
Fig. 4 Prior Art
FIG. 4 is a fragmentary diagrammatic view in axial section of the inner shroud and of vanes of the FIG. 3 guide-vane stage, once fabrication has terminated.

In the prior art, the step of applying the resin 26 is preceded by a step of injecting resin 30 into the above-mentioned clearance 25, this step being shown diagrammatically in FIGS. 3 and 4.

The resin 30 is injected by means of a syringe 32 that is filled and handled by an operator. Resin 30 is injected into the clearance 25 all around each vane 24 so as to fill in the clearance and consequently prevent resin 26 from passing through the clearance when it is applied on the inside surface of the inner shroud 20.

Nevertheless, as explained above, this injection step presents numerous drawbacks.

The invention provides a simple and effective solution to this problem by replacing the resin 20 that is injected into the clearance by gaskets that are mounted on the radially inner ends of the vanes so as to provide radial sealing between those ends and the edges of orifices in the inner shroud, subsequently limiting or preventing resin from passing between those elements when resin is applied to the inside surface of the shroud.

Figure 5:
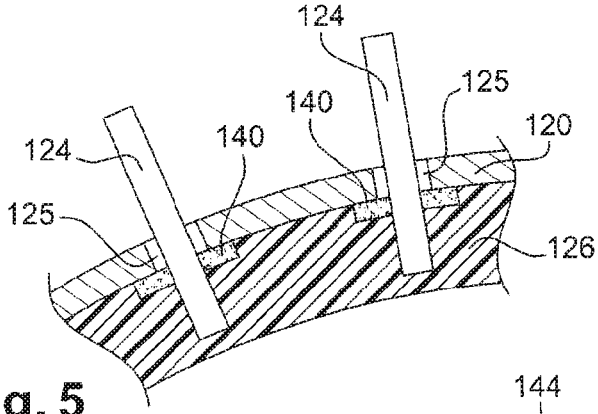
FIG. 5 is a fragmentary diagrammatic view in axial section of the inner shroud and of vanes of the guide-vane stage of the invention.
Figure 6:
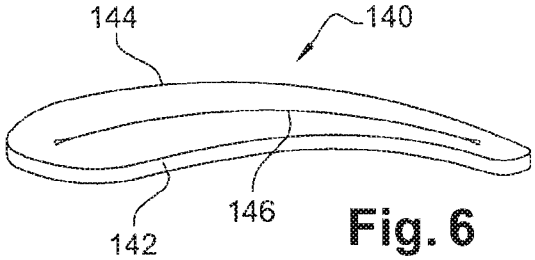
FIG. 6 is a diagrammatic view in perspective of a gasket of the invention in its free state without stress.
Figure 7:
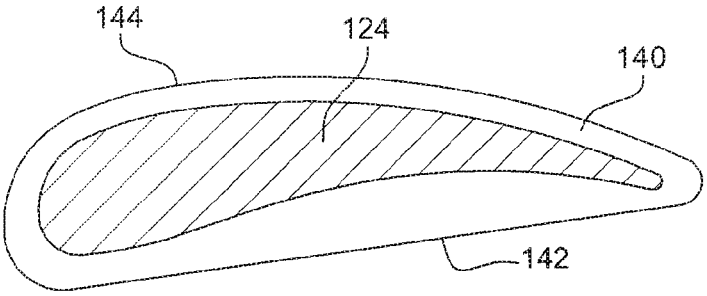
FIG. 7 is a diagrammatic view in perspective of the FIG. 6 gasket when mounted on a vane end.

FIGS. 5 to 10 show an embodiment of the invention, FIG. 6 showing a gasket 140 in its free state without stress, and FIG. 7 showing the same gasket 140 once mounted on the radially inner end of a vane 124.

Each gasket 140 is a member that is thin and flat having a general shape that is slightly curved and that corresponds substantially to the shape of a section of a vane 124. Each gasket 140 has a concave curved edge 142 and a convex curved edge 144, which edges are to extend respectively beside the pressure side and the suction side of the vane, as can be seen in FIG. 7.

The gasket 140 includes a slit that is formed by a slightly curved line of cut 146 extending over a major fraction of the length of the gasket and substantially in its middle, i.e. halfway between the above-mentioned edges 142 and 144. The slit is of small transverse size such that in the free state without stress (FIG. 6), the facing edges of the slit are in the immediate vicinity of each other.

The line of cut 146 presents curvature that is substantially identical to the curvature of the suction side of the vane, so that the portion of the gasket 140 that extends beside the suction side of the vane is deformed little when in the mounted position on the vane (FIG. 7). The portion of the gasket 140 that extends beside the pressure side of the vane is designed to deform and match closely to the shape of the vane. In the mounted position, the gasket 140 forms a continuous and uninterrupted band around the vane 124.

As can be seen in FIG. 5, the radially inner end of each vane 124 passes through the slit in a gasket 140 that is pressed against the inside surface of the inner shroud 120. The gaskets are of transverse dimensions that are greater than the transverse dimensions of the clearance 125 between the vanes and the edges of the orifices in the shroud, and they bear radially against the inside surface of the shroud over substantially the entire perimeter of the vanes. The gaskets 140 and the radially inner ends of the vanes 124 are embedded in the resin 126 that is applied to the inside surface of the shroud 120, this resin being prevented from passing through the clearance 125 by the gasket 140.

Once the resin 126 has been cast, it exerts pressure on the gasket that keeps it pressed against the inner shroud 120, this pressure being a function of the surface area of the gasket that is covered in resin.

Figure 8:
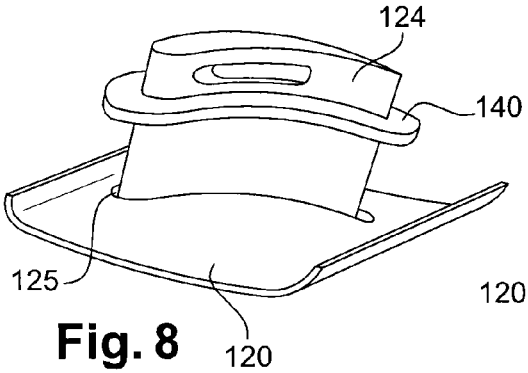
FIGS. 8 to 10 are diagrammatic views in perspective of the inner shroud and of vanes of a guide-vane stage of the invention, and they show steps in the fabrication of this stage.
Figure 9:
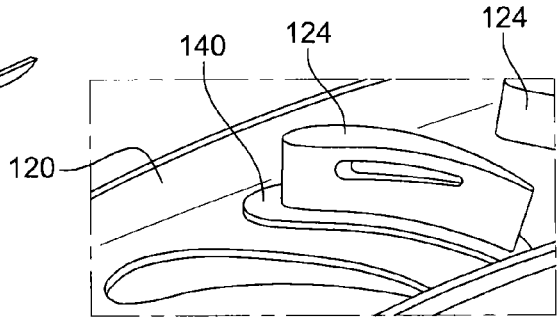
Figure 10:
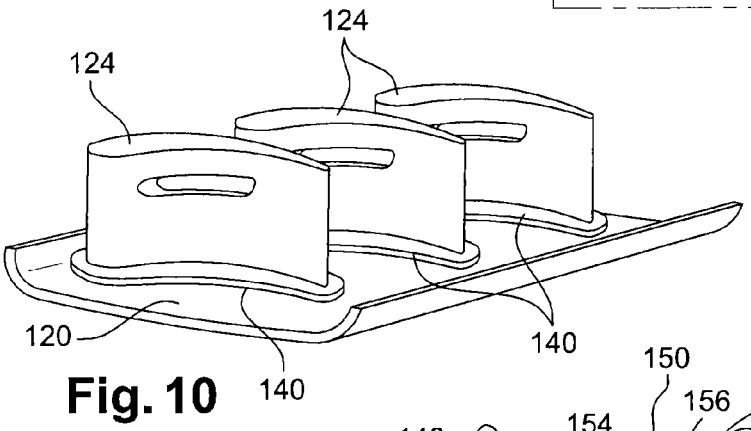

FIGS. 8 to 10 show steps of mounting gaskets 140 of the invention. Each gasket 140 is mounted on the radially inner end of a vane 124 (FIG. 8) and is then moved along the vane until it bears radially against the inside surface of the inner shroud 120 (FIG. 9). This observation is repeated for the other vanes so that a gasket 140 is mounted on the radially inner end of each vane 124 of the guide-vane stage.

Figure 11:
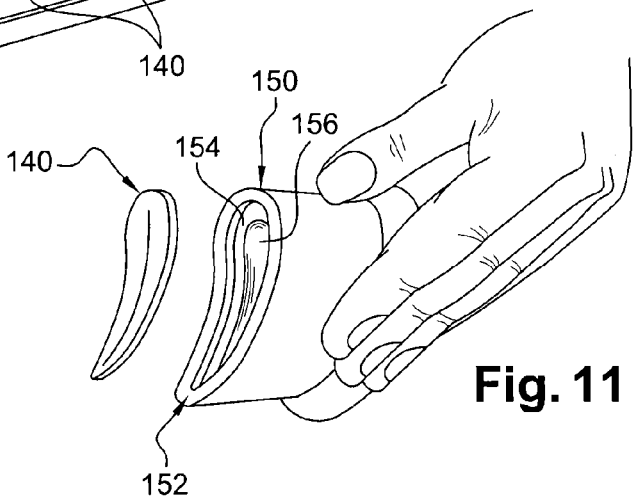
FIG. 11 shows a tool for mounting a gasket of the invention on the end of a vane of a guide-vane stage.

Each gasket 140 may be mounted on a vane 124 either manually or by means of a tool such as that shown in FIG. 11. The tool 150 is of elongate shape and includes a stepped longitudinal recess 152, i.e. an internal recess comprising two superposed portions or stages, these portions having different dimensions and/or shapes. The recess 152 has a first portion 154 of shape substantially complementary to the shape of a gasket 140 (preferably in its stressed state when mounted on a vane) and having one end opening out into the end of the tool, and a second portion 156 of shape substantially complementary to the shape of the radially inner end of a vane 124 and having a depth that is not less than the length of the end portion of the vane extending beyond the gasket when the gasket is in the mounted position on the vane.

The tool 150 may be used as follows. A gasket 140 is engaged in the first portion 154 of the recess 152 of the tool, and then the tool is engaged on the radially inner end of a vane 124. During this engagement, the gasket 140 deforms and becomes engaged on the vane, which vane penetrates into the second portion 156 of the recess 152 in the tool. As the vane penetrates further into this portion 156, the gasket 140 is moved over the vane. When the radially inner end of the vane comes to bear against the bottom of the recess 152 in the tool, the gasket is pressed against or is in the immediate vicinity of the inside surface of the inner shroud 120. The tool 150 may then be withdrawn from the vane and used to mount a gasket on another vane.

In order to enhance the adhesion of the gasket 140 on the inside surface of the shroud 120, a suitable substance such as an adhesive or even a small quantity of resin 126 (made of the same material as the gaskets 140) may be deposited on this inside surface or on the gaskets before they are mounted on inner ends of the vanes.

Figure 12:
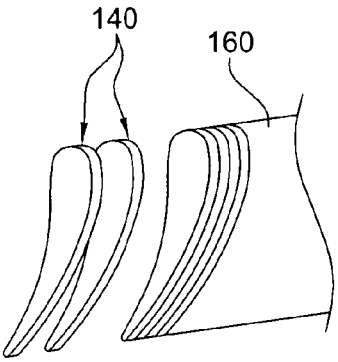
FIG. 12 is a highly diagrammatic view in perspective of an extrusion from which slices are cut form the gaskets of the invention.
Figure 13:
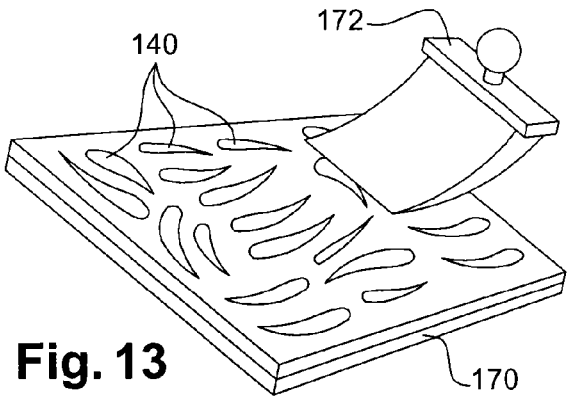
FIG. 13 is a diagrammatic view in perspective of a plate for molding gaskets of the invention.

FIGS. 12 and 13 show variants for fabricating gaskets 140 of the invention.

In FIG. 12, the gaskets 140 are made from slices that are cut from a section member 160 of elongate shape that is obtained by extrusion. A line of cut 146 of the above-described type is then made in each of the gaskets 140.

In FIG. 13, the gaskets 140 are made by molding, the mold being formed by recesses in the surface of a plate 170 onto which the material of the gaskets is applied in a liquid or pasty form, with the surface then being scraped by means of a suitable tool 172 so as to remove excess material. The plate is then heated in an oven and a line of cut 146 is then made in each gasket 140.

The gaskets 140 and the resin 126 are preferably made of the same material, which may be based on RTV silicone, for example.

What is claimed is:

1. A gasket for a turbine engine guide-vane stage, the turbine engine guide-vane stage including at least one vane and the gasket being associated with the at least one vane, the gasket comprising:

a material being formed in a manner so as to have an outbound peripheral concave curved edge in communication with an opposing, outbound peripheral convex curved edge, the gasket being received on the at least one vane so that the outbound peripheral concave curved edge extends besides a pressure side of the at least one vane and the outbound peripheral convex curved edge extends besides a suction side of the at least one vane; and a slit being cut in the material having an angle of curvature that is identical to an angle of curvature of the suction side of the at least one vane, the cut slit being disposed intermediate the outbound peripheral concave curved edge and the outbound peripheral convex curved edge and extending along respective lengths of the outbound peripheral concave curved edge and the outbound peripheral convex curved edge, wherein:

when the gasket is in a free state of the gasket such as when the gasket is not received on the at least one vane, the cut slit forms a closed cut slit such that edges of the material adjacent the closed cut slit and disposed between the outbound peripheral concave curved edge and the outbound peripheral convex curved edge face each other in an opposed, adjacent relationship in a manner so that the respective edges of the material positioned adjacent to the closed cut slit are generally engagingly contacting each other along a length of the closed cut slit, and when the gasket is in an opened state of the gasket such as when the gasket is received on the at least one vane, the at least one vane engagingly penetrates the closed cut slit to form an open cut slit in which the edges of material adjacent the penetrated cut slit are spaced apart from each other by the at least one vane.

2. A compressor guide-vane stage for a turbine engine, the compressor guide-vane stage comprising:

an inner shroud;

an outer shroud coaxial with the inner shroud;

substantially radial vanes extending between the inner shroud and the outer shroud, radially outer ends of the substantially radial vanes being welded to the outer shroud and radially inner ends of the substantially radial vanes being received in orifices in the inner shroud;

a clearance formed in each orifice being positioned outbound from, and surrounding the radially inner end of the corresponding received substantially radial vane;

a plurality of gaskets, each gasket of the plurality of gaskets being according to claim 1, one gasket of the plurality of gaskets being mounted on the radially inner end of each substantially radial vane to surround each substantially radial vane in which each substantially radial vane of the substantially radial vanes passes completely through the slit of the one gasket to form the mounted one gasket on the substantially radial vane, and each mounted one gasket being further positioned to engage and overlie a portion of a radially inside surface of the inner shroud adjacent each orifice in a manner so as to further overlie each clearance; and a viscous polymerizable sealing resin applied to overlie, in combination, the radially inside surface of the inner shroud and the positioned, mounted plurality of gaskets so that the positioned, mounted plurality of gaskets and the radially inside surface of the inner shroud are collectively entombed by the applied viscous polymerizable sealing resin, the overlying applied viscous polymerizable sealing resin forming a hardened polymerizable sealing resin of the inner shroud after a period of time to define an abradable track of the inner shroud, whereby the positioned, mounted plurality of gaskets limit and/or block passage of the viscous polymerizable sealing resin from entering the respective clearances when the viscous polymerizable sealing resin is applied to overlie, in combination, the radially inside surface of the inner shroud and the positioned, mounted plurality of gaskets.

3. The compressor guide-vane stage according to claim 2, wherein the viscous polymerizable sealing resin and each gasket of the plurality of gaskets include a same material based on silicone.

4. The compressor guide-vane stage according to claim 2, wherein each gasket of the plurality of gaskets has a thickness of about 2 millimeters to 3 millimeters.

5. The gasket according to claim 1, wherein said gasket includes silicone.

6. A method of assembling a guide-vane stage comprising substantially radial vanes, the method comprising:

a) engaging radially inner ends of the substantially radial vanes in orifices in an inner shroud;

b) welding radially outer ends of the substantially radial vanes to an outer shroud;

c) engaging a gasket according to claim 1 on the radially inner end of each substantially radial vane such that the gasket goes from the free state to the opened state by passing the substantially radial vane through the slit provided on the gasket until the gasket comes into contact with a radially inside surface of the inner shroud such that the gasket engages and overlies a portion of the radially inside surface of the inner shroud adjacent each orifice in manner so as to further overlie a clearance formed in each orifice being positioned outbound from, and surrounding the radially inner end of the corresponding substantially radial vane; and d) applying a viscous polymerizable sealing resin on the radially inside surface of the inner shroud and on the engaged gaskets such that the radially inside surface of the inner shroud and the gaskets are collectively entombed in the polymerizable sealing resin, each engaged gasket limiting and/or blocking passage of the polymerizable sealing resin from entering the respective clearance when the polymerizable sealing resin has been applied.

7. The method according to claim 6, wherein prior to step c), said method includes coating the radially inside surface of the inner shroud with a substance that enhances adhesion of the gaskets on said radially inside surface of the inner shroud.

8. The method according to claim 6, wherein step c) is performed with a tool of elongate shape, the tool including a stepped longitudinal recess, said longitudinal recess including:

a first portion with a shape substantially complementary to a shape of one of the gaskets and situated at one end of the tool, and a second portion with a shape substantially complementary to a shape of the radially inner end of the substantially radial vanes and having a depth that is not less than a length of a radially inner end portion of the substantially radial vane that extends beyond the one of the gaskets when the one of the gaskets is mounted on one of the substantially radial vanes.

9. The method according to claim 6, further comprising, prior to step a), a step of fabricating the gasket, by cutting a slice from an extruded section member of elongate shape, or by molding in a recess in a surface of a plate that is scraped after a gasket forming resin has been deposited and before the gasket forming resin has hardened.

* * * * *